US010594079B2

(12) United States Patent
Yasuda

(10) Patent No.: US 10,594,079 B2
(45) Date of Patent: Mar. 17, 2020

(54) LEVER-TYPE CONNECTOR

(71) Applicant: Sumitomo Wiring Systems, Ltd., Yokkaichi, Mie (JP)

(72) Inventor: Tomoaki Yasuda, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/429,335

(22) Filed: Jun. 3, 2019

(65) Prior Publication Data

US 2019/0379159 A1 Dec. 12, 2019

(30) Foreign Application Priority Data

Jun. 6, 2018 (JP) ..... 2018-108702

(51) Int. Cl.

| | |
|---|---|
| ***H01R 13/629*** | (2006.01) |
| ***H01R 13/703*** | (2006.01) |
| ***H01R 13/713*** | (2006.01) |
| ***H01R 13/71*** | (2006.01) |

(52) U.S. Cl.

CPC . *H01R 13/62938* (2013.01); *H01R 13/62955* (2013.01); *H01R 13/7036* (2013.01); *H01R 13/71* (2013.01); *H01R 13/713* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,095,833 | A * | 8/2000 | Osawa | H01R 13/62933 439/157 |
| 6,644,992 | B2 * | 11/2003 | Maegawa | H01R 13/62938 439/157 |
| 7,300,294 | B2 * | 11/2007 | Fukatsu | H01R 13/62938 439/157 |
| 7,661,978 | B2 * | 2/2010 | Kobayashi | H01R 13/62938 439/157 |
| 8,147,261 | B2 * | 4/2012 | Horiuchi | H01R 13/514 439/157 |
| 9,373,913 | B2 * | 6/2016 | Noda | H01R 13/62938 |

FOREIGN PATENT DOCUMENTS

| | | |
|---|---|---|
| JP | 11-067337 | 3/1999 |

* cited by examiner

*Primary Examiner* — Briggitte R. Hammond
(74) *Attorney, Agent, or Firm* — Gerald E. Hespos; Michael J. Porco; Matthew T. Hespos

(57) ABSTRACT

A lever (24) mounted on a male housing (10) is formed with a connecting cam surface (29) capable of pressing a cam pin (41) of a female housing (40) while being kept out of contact with cam projections (23) in the process of rotating the lever (24) from an initial position to a connection position, and the lever (24) is formed with an escaping space (31). In the process of rotating the lever (24) from the initial position to the connection position in a state where the male housing (10) and the female housing (40) are separated and the moving plate (18) is at a protecting position, the cam projections (23) of the moving plate (18) are accommodated into the escaping space (31) while being kept out of contact with the connecting cam surface (29).

10 Claims, 14 Drawing Sheets

LEVER-TYPE CONNECTOR

BACKGROUND

Field of the Invention

The invention relates to a lever-type connector.

Related Art

Japanese Unexamined Patent Publication No. H11-67337 discloses a lever-type connector with a male housing having a tubular receptacle projecting forward, a lever rotatably mounted on the male housing, a moving plate accommodated in the receptacle with tabs of male terminal fittings positioned through the moving plate, and a female housing to be fit into the receptacle. The moving plate is movable between a protecting position where front parts of the tabs are passed through the moving plate and a retracted position behind the protecting position.

In connecting the housings, the female housing is fit into the receptacle with the lever located at an initial position. A cam pin of the female housing and a cam projection of the moving plate are united and enter a cam groove of the lever. The lever then is rotated toward a connection position. Accordingly, the female housing is pulled toward the male housing and the housings are connected due to a boosting action created by the sliding contact of the cam pin and the cam groove.

The lever can be rotated to the initial position with the housing connected. Thus, the moving plate moves toward the front end of the receptacle to push the female housing away from the male housing due to a boosting action created by the sliding contact of the cam projection and the cam groove. Accordingly, the housings can be separated. If the lever returns to the initial position, the moving plate returns to the protecting position where the front parts of the tabs are passed through the moving plate.

In the above lever-type connector, if the lever is rotated between the initial position and the connection position with the housings separated, the moving plate is moved toward a back of the receptacle by the sliding contact of the cam projection and the cam groove. When the moving plate moves toward the back side of the receptacle, most parts of the tabs are exposed forward of the moving plate, and external matter may interfere with the tabs.

The invention was completed in view of the above situation and aims to restrict movement of a moving plate when a lever is rotated with the male female housings separated.

SUMMARY

The invention is directed to a lever-type connector with a male housing including a tubular receptacle projecting toward a front surface end. Male terminal fittings are mounted in the male housing and include tabs surrounded by the receptacle. A moving plate is accommodated in the receptacle and is movable between a protecting position where tips of the tabs are positioned through the moving plate and a retracted position backward of the protecting position. A cam projection is formed on the moving plate. A lever is mounted on the male housing and is rotatable between an initial position and a connection position. A female housing includes a cam pin and is configured to fit into the receptacle. A connecting cam surface is formed in the lever and is capable of pressing the cam pin in a connecting direction while being kept out of contact with the cam projection in the process of rotating the lever from the initial position to the connection position. An escaping space is formed in the lever, and the cam projection is accommodated into the escaping space while being kept out of contact with the connecting cam surface in the process of rotating the lever from the initial position to the connection position in a state where the male housing and the female housing are separated and the moving plate is at the protecting position.

If the lever is rotated from the initial position to the connection position with the housings separated, the cam projection is accommodated into the escaping space and the connecting cam surface does not contact the cam projection in the escaping space. Thus, a pressing force in a connecting direction does not act on the moving plate. In this way, the moving plate can be held at the protecting position.

The lever may be formed with a cam groove capable of accommodating the cam projection and the cam pin in a process of connecting the male housing and the female housing. The connecting cam surface may be formed in the cam groove. The escaping space may be adjacent to the connecting cam surface and may communicate with the cam groove. According to this configuration, the cam projection and the cam pin can be moved in the cam groove while being united in a step of connecting the housings. The cam groove doubles as a movement path for the cam projection in the connecting process of the housings. Thus, the shape of the lever can be simplified as compared to the case where the lever has a movement path dedicated for the cam projection separate from the cam groove.

The escaping space may be shallower than the cam groove, and the cam pin may project farther than the cam projection. Accordingly, the cam pin cannot erroneously enter the escaping space when connecting the housings.

The escaping space may be farther from a center of rotation of the lever than the connecting cam surface. Accordingly, the cam projection does not approach the center of rotation of the lever in the process of rotating the lever from the initial position to the connection position with the housings separated. Thus, the moving plate can be held at the protecting position.

The lever may have a separating cam surface for moving the moving plate toward the protecting position by pressing the cam projection when separating the male and female housings. According to this configuration, if the lever is rotated from the connection position to the initial position with the housings connected, the separating cam surface presses the cam projection to move the moving plate to the protecting position.

The lever may have a restricting surface that faces a center of rotation of the lever and extends along an outer periphery of the escaping space. Accordingly, the cam projection contacts the restricting surface. Thus, the moving plate at the protecting position cannot separate toward the front surface side of the receptacle.

DETAILED DESCRIPTION

Figure 1:
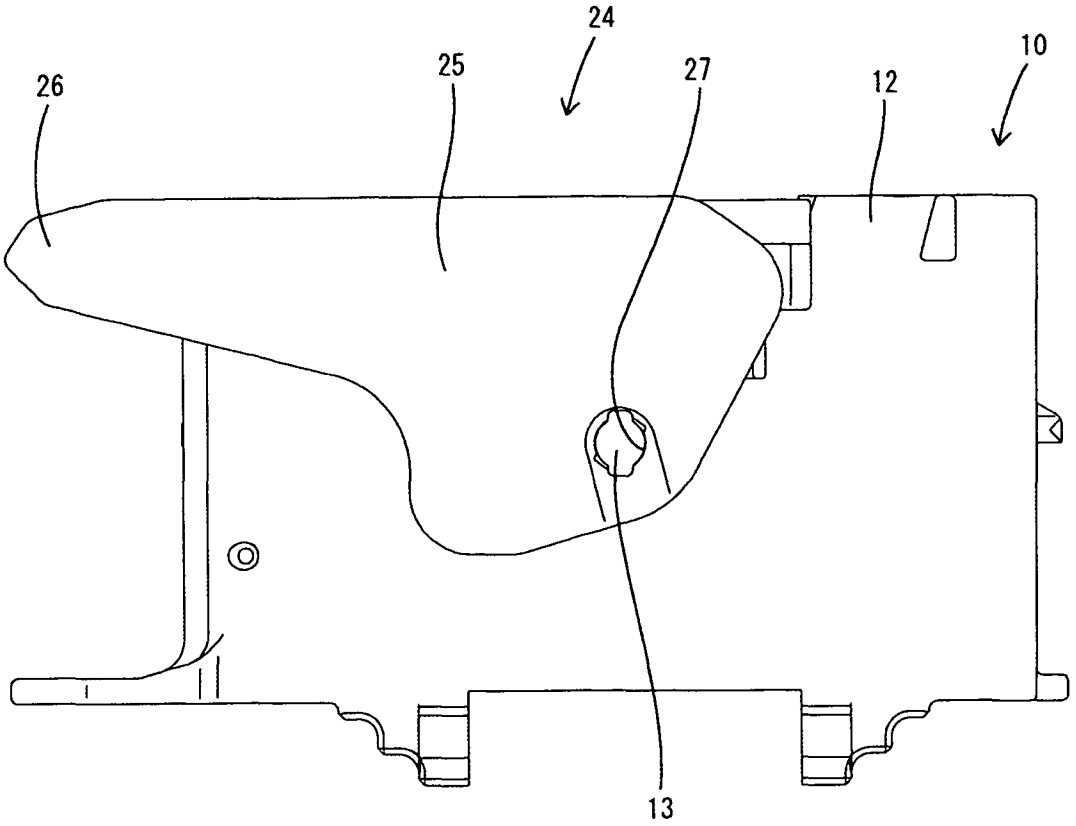
FIG. 1 is a side view showing a state where a lever is at an initial position on a male housing constituting a lever-type connector of one embodiment.
Figure 2:
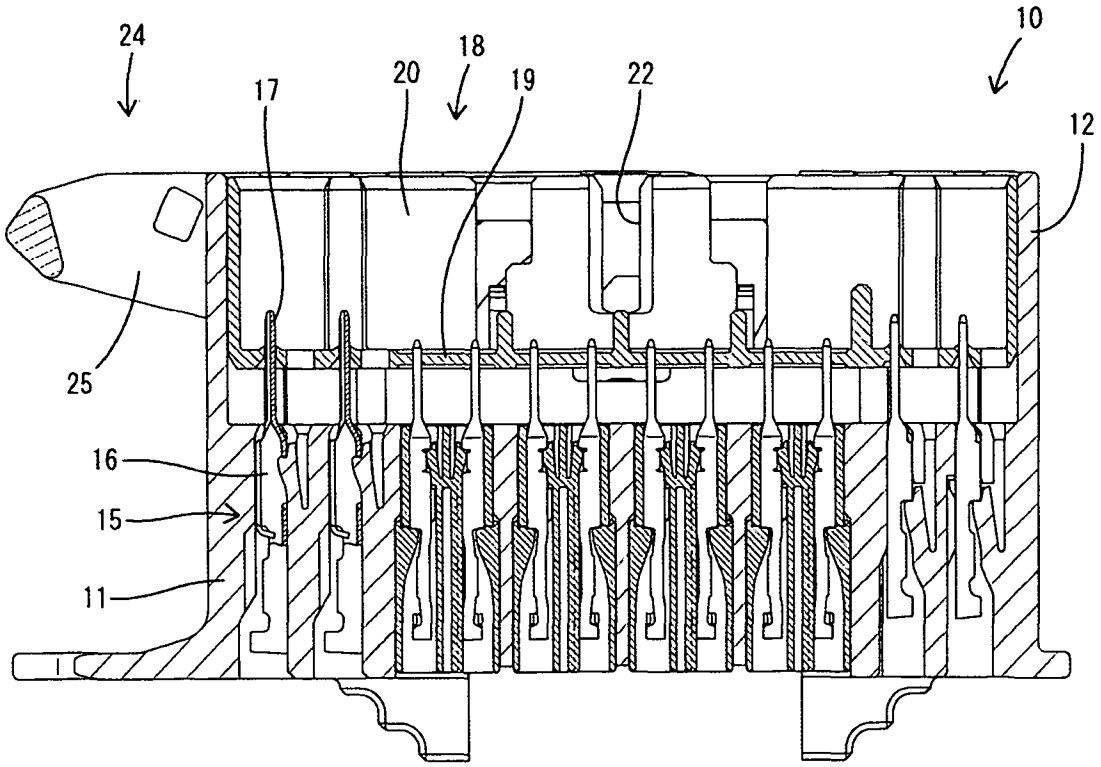
FIG. 2 is a side view in section when the lever is at the initial position with the male housing and a female housing separated.
Figure 3:
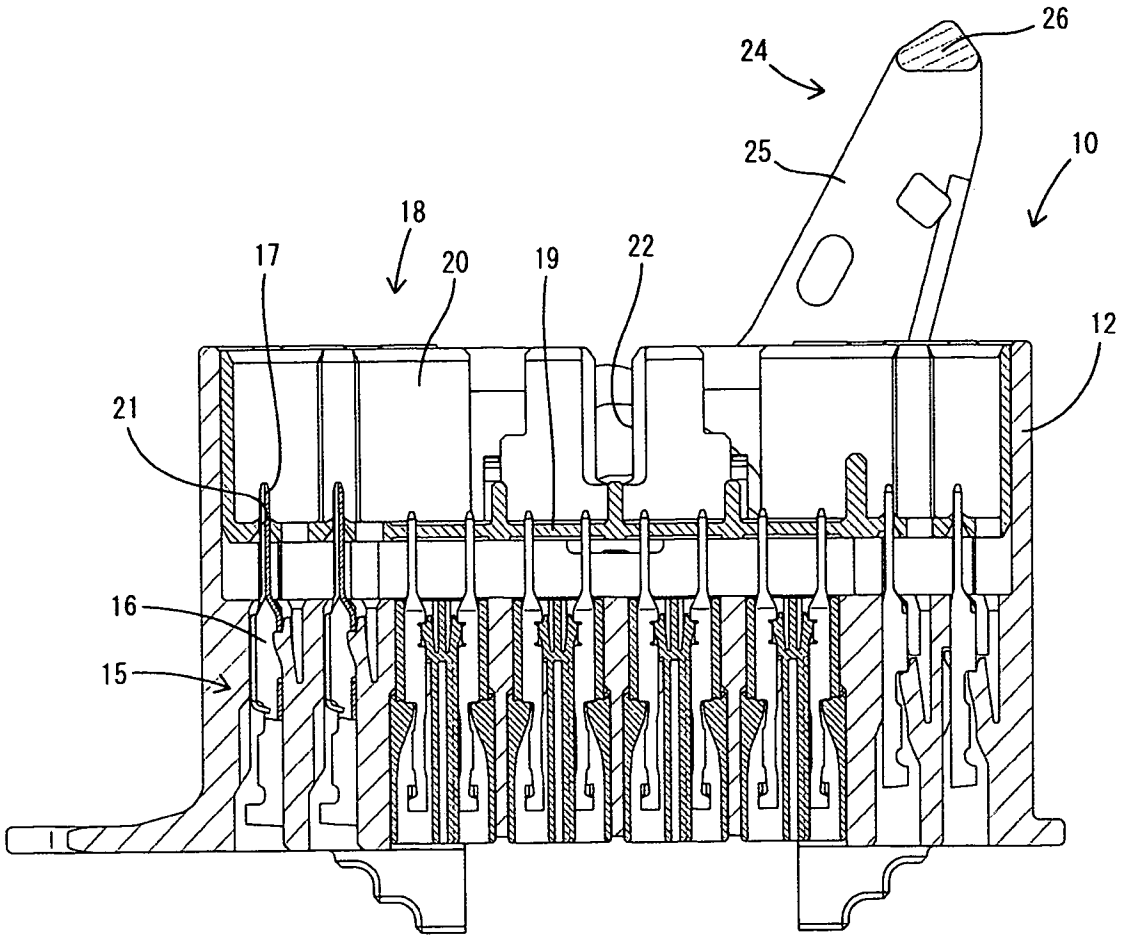
FIG. 3 is a side view in section when the lever is at a connection position with the male housing and the female housing separated.

An embodiment of the invention is described with reference to FIGS. 1 to 14. Note that, in the following description, a left side in FIGS. 1 to 5 and 7 to 9 is defined as a front concerning a front-rear direction. Concerning a vertical direction, upper and lower sides shown in FIGS. 1 to 14 are defined as the top and bottom. Note that the top and front are synonymous and a bottom and a back are synonymous.

A lever-type connector of this embodiment includes a male housing 10 and a female housing 40, both of which are made of synthetic resin. The male housing 10 has a tubular receptacle 12 projecting toward the front, and the female housing 40 can fit into the receptacle 12. Bilaterally symmetrical cam pins 41 project on left and right outer side surfaces of the female housing 40. Male terminal fittings 15 are mounted in the male housing 10 and have tabs 17 surrounded by the receptacle 12.

A moving plate 18 is accommodated in the receptacle 12 and is made of synthetic resin. The moving plate 18 is movable in the vertical direction between a protecting position where tips of the tabs 17 are positioned through the moving plate 18 and a retracted position backward of (below) the protecting position. The moving plate 18 is formed with left and right pairs of cam projections 23. A lever 24 is mounted on the male housing 10 and is made of synthetic resin. The lever 24 is rotatable between an initial position and a connection position and exhibits a boosting function for connecting the female housing 40 and the male housing 10 by being rotated from the initial position to the connection position while sliding in contact with the cam pins 41.

Male Housing 10 and Male Terminal Fittings 15

The male housing 10 includes a block-like terminal holding portion 11, and the receptacle 12 in the form of a rectangular tube projects up from the outer peripheral edge of the terminal holding portion 11. Terminal bodies 16 of the male terminal fittings 15 are accommodated in the terminal holding portion 11, and the tabs 17 formed on tips of the male terminal fittings 15 are accommodated in the receptacle 12 while projecting up from the terminal holding portion 11. Left and right rotary shafts 13 (center of rotation of the lever 24) are formed on left and right outer side surfaces of the male housing 10. Further, left and right cutouts 14 are formed in both left and right outer walls of the receptacle 12 by being cut down from upper ends of the outer walls (opening end edge of the receptacle 12).

Moving Plate 18

The moving plate 18 is a single component including a plate body 19 in the form of a flat plate whose plate thickness direction is parallel to a moving direction of the moving plate 18 and a peripheral wall 20 projecting up from the outer periphery of the plate body 19. The plate body 19 is formed with positioning holes 21 for individually positioning the tabs 17 passed therethrough. Two bilaterally symmetrical guide grooves 22 are formed in left and right side panels of the peripheral wall 20 by being cut down (toward the back surface side) from the upper opening edge of the peripheral wall 20.

Front and rear cam projections 23 are formed on left and right outer side surfaces of the peripheral wall 20 and project from a lower part of an edge of the guide groove 22. With the moving plate 18 in the receptacle 12, the cam projections 23 project out from the outer side surface of the receptacle 12 through the cutout 14. The cam projections 23 can be accommodated in a cam groove 28 and an escaping space 31 of the lever 24 to be described later.

The moving plate 18 can move between a protecting position (see FIGS. 2 and 3) and a retracted position (see FIG. 7) without being inclined by causing the peripheral wall 20 to slide in contact with the inner peripheral surface of the receptacle 12. The tips of the tabs 17 are passed through the positioning holes 21 of the plate body 19 with the moving plate 18 at the protecting position, and an upward projecting dimension of the tabs 17 from the plate body 19 is small.

With the moving plate 18 at the retracted position, base ends of the tabs 17 are passed through the positioning holes 21 since the plate body 19 is in contact with or near the upper end surface of the terminal holding portion 11 (back bottom surface of the receptacle 12). Thus, the upward projecting dimension of the tabs 17 from the plate body 19 is longer than that when the moving plate 18 is at the protecting position.

Lever 24

The lever 24 is a single component with two bilaterally symmetrical plate-like arms 25 and an operating portion 26 coupling tips of the arms 25 to each other. Bearing holes 27 penetrate the arms 25 in a lateral direction at positions on base ends of the arms 25. The lever 24 is mounted on the male housing 10 by fitting the bearing holes 27 to the rotary shafts 13 and is rotatable between an initial position (see FIGS. 1, 2, 4 and 8) and a connection position (see FIGS. 3, 5, 7 and 9). With the lever 24 mounted on the male housing 10, the arms 25 are face the outer side surfaces of the receptacle 12 and cover the cutouts 14.

Two bilaterally symmetrical cam grooves 28 are recessed in inner side surfaces of the arms 25. Each cam groove 28 is curved to surround the bearing hole 27, and an entrance 28E of the cam groove 28 is open in the outer peripheral edge of the arm 25. A radial distance from the bearing hole 27 to the cam groove 28 is longest at the entrance 28E of the cam groove 28 and shortest at a back part of the cam groove 28.

The cam projections 23 of the moving plate 18 and the cam pins 41 of the female housing 40 move in the cam grooves 28 to connect and separate the housings 10, 40. An inner side surface of the cam groove 28 on an outer side facing the bearing hole 27 defines a connecting cam surface 29. An inner side surface of the cam groove 28 on an inner side back to back with the bearing hole 27 defines a separating cam surface 30. The separating cam surface 30 is closer to the rotary shaft 13 than the connecting cam surface 29.

Two bilaterally symmetrical escaping spaces 31 are recessed on the inner surfaces of the arms 25. The cam projections 23 move in the escaping spaces 31 in the process of rotating the lever 24 between the initial position and the connection position with the housings 10, 40 separated. A depth of the escaping space 31 from the inner side surface of the arm 25 parallel to an axis of the rotary shaft 13 is smaller than a depth of the cam groove 28. Thus, the connecting cam surface 29 is in an area backward of the escaping space 31 in a depth direction of the cam groove 28 and the escaping space 31.

An insertion depth of the cam projections 23 into the escaping space 31 is equal to or slightly smaller than the depth of the escaping space 31. When the cam projections 23 move in the escaping space 31, projecting end surfaces (left end surfaces in FIG. 6) of the cam projections 23 are kept out of contact with or lightly slide in contact with the inner surface of the escaping space 31. Further, the separating cam surface 30 is in the same depth area as the escaping space 31 in the depth direction of the cam groove 28 and the escaping space 31. Thus, the outer peripheral surfaces of the cam projections 23 and the outer peripheral surface of the cam pin 41 to be described later can slide in contact with the separating cam surface 31. Although the cam pin 41 to be described later slides in contact with the connecting cam surface 29, the cam projections 23 cannot contact the connecting cam surface 29.

The escaping space 31 is farther from the rotary shaft 13 than the connecting cam surface 29 and the separating cam surface 30 in the inner side surface of the arm 25. The escaping space 31 communicates with the cam groove 28 over the entire area from an entrance 31E thereof to a back end. That is, the entrance 31E of the escaping space 31 is adjacent to and communicates with the entrance 28E of the cam groove 28. Further, the escaping space 31 is adjacent to the connecting cam surface 29 in a radial direction that is perpendicular to the rotary shaft 13 and that intersects a rotating direction of the lever 24.

The arm 25 is formed with a restricting surface 32 facing the rotary shaft 13 in the radial direction. The restricting surface 32 is formed over the entire area of the escaping space 31 from the entrance 31E to the back end to extend along the outer peripheral edge of the escaping space 31. An area of the restricting surface 32 remote from the entrance 31E of the escaping space 31 is arcuate and substantially concentric with the rotary shaft 13. A radial distance between the arcuate area of the restricting surface 32 and a center of the rotary shaft 13 exceeds a distance from the center of the rotary shaft 13 to the sides of the cam projections 23 that are most distant from the rotary shaft 13 when the moving plate 18 is at the protecting position. In this way, the cam projections 23 are kept out of contact with the restricting surface 32 in the entire process of moving the cam projections 23 in the escaping space 31.

Female Housing 40

The female housing 40 is a block and can fit into the moving plate 18 (receptacle 12). Female terminal fittings 42 are accommodated in the female housing 40. Two bilaterally symmetrical cam pins 41 project on left and right outer side surfaces of the female housing 40. The cam pin 41 is sandwiched between the cam projections 23 and units with the cam projections 23 in the front-rear direction when the female housing 40 is fit into the moving plate 18. The cam pin 41 and the cam projections 23 are displaceable vertical direction (parallel to a connecting/separating direction of the housings 10, 40) while being united.

Figure 10:
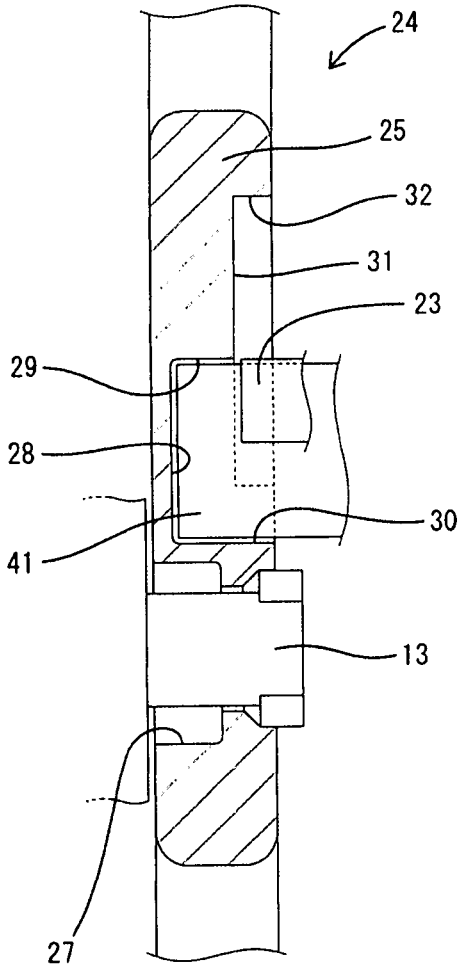
FIG. 10 is a section along Y-Y of FIG. 9.
Figure 11:
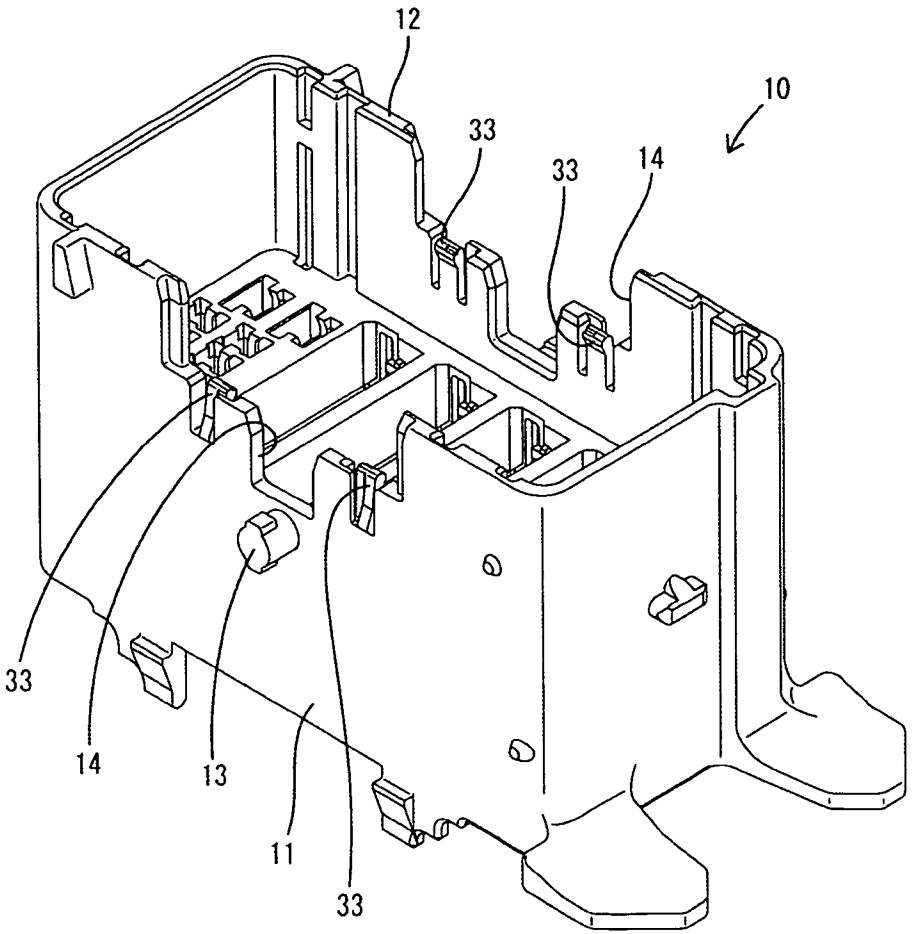
FIG. 11 is a perspective view of the male housing.
Figure 12:
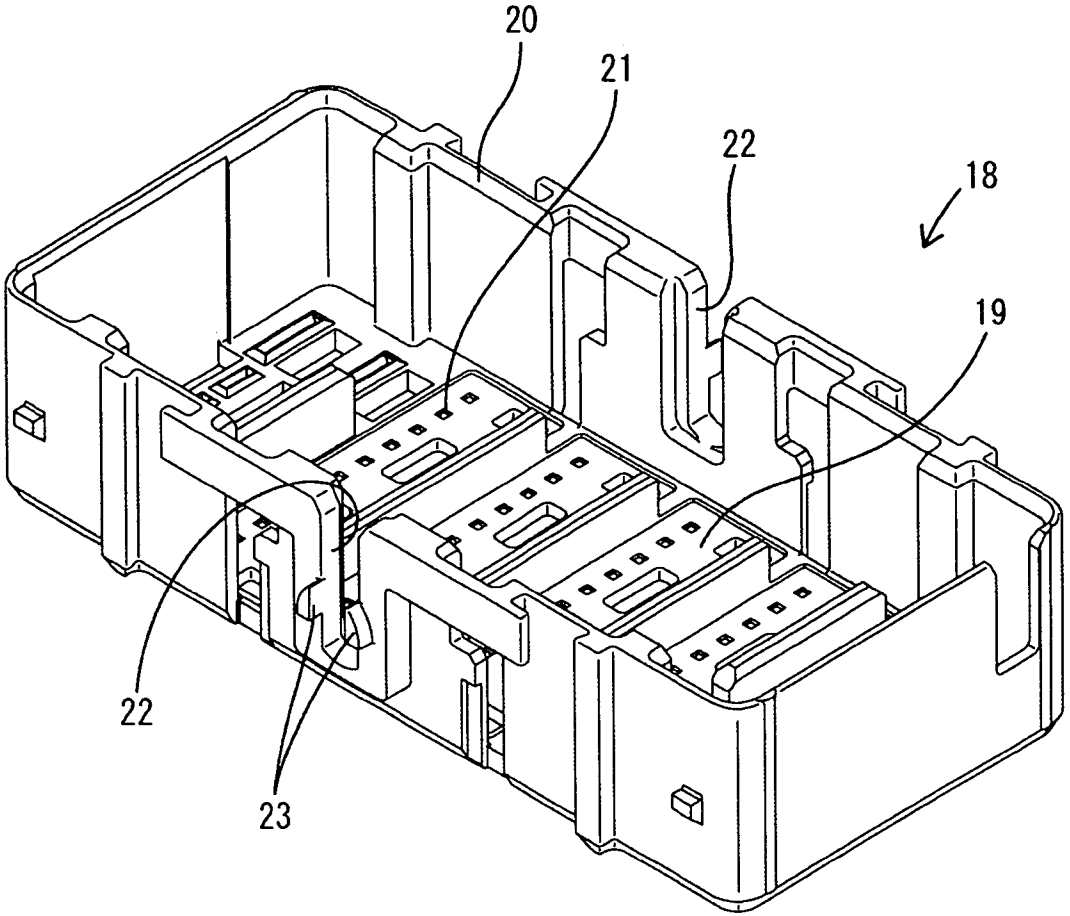
FIG. 12 is a perspective view of the moving plate.
Figure 13:
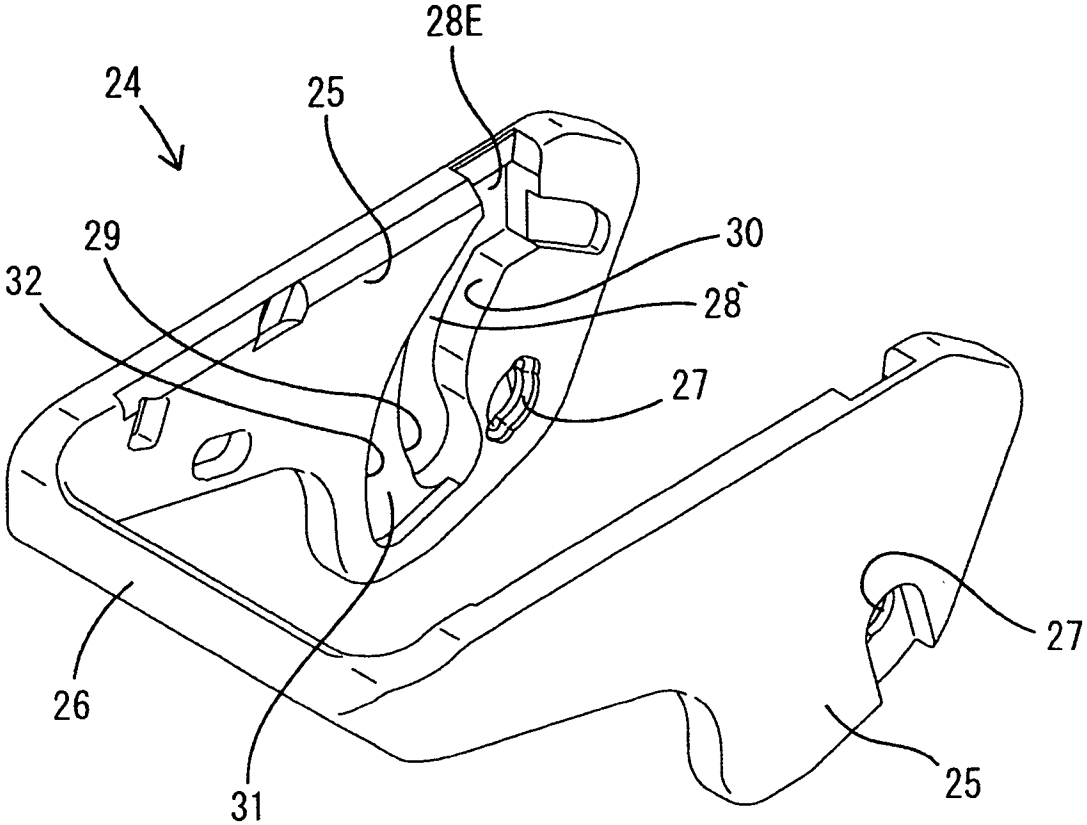
FIG. 13 is a perspective view of the lever.
Figure 14:
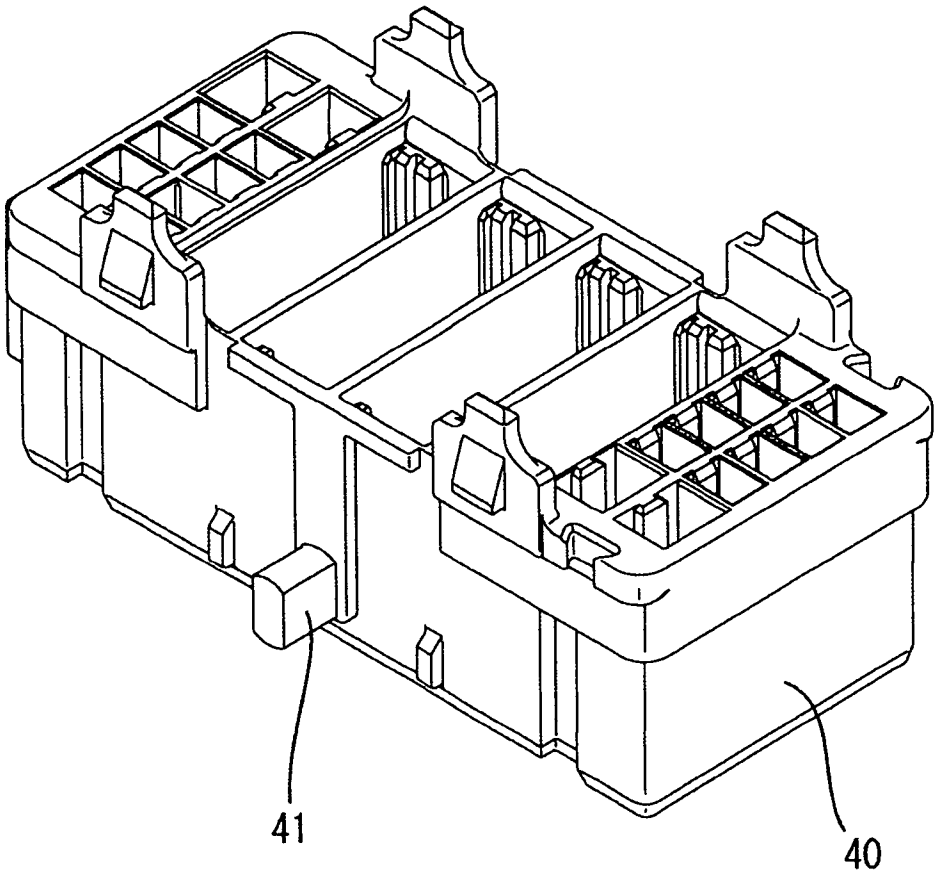
FIG. 14 is a perspective view of the female housing.

With the cam pin 41 and the cam projections 23 united, a projecting end of the cam pin 41 projects laterally and parallel to the axis of the rotary shaft 13 from projecting ends of the cam projections 23, as shown in FIG. 10. Further, a vertical dimension of the cam pin 41 exceeds vertical dimensions of the cam projections 23 so that at least one of a front end part and a rear end part of the cam pin 41 projects forward or rearward of the cam projections 23 with the cam pin 41 and the cam projections 23 united.

Sliding resistance does not impose a large load on the moving plate 18 in the process of connecting/separating the male housing 10 and the female housing 40. Thus, the cam projections 23 are shaped and dimensioned to have relatively low rigidity and strength. In contrast, sliding resistance between the male housing 10 and the female housing 40 is large due to resilient contact between the male terminal fittings 15 and the female terminal fittings 42, and a large load acts on the cam pins 41 from the lever 24. Therefore, the cam pins 41 are shaped and dimensioned to have higher rigidity and strength than the cam projections 23.

Functions and Effects

Figure 4:
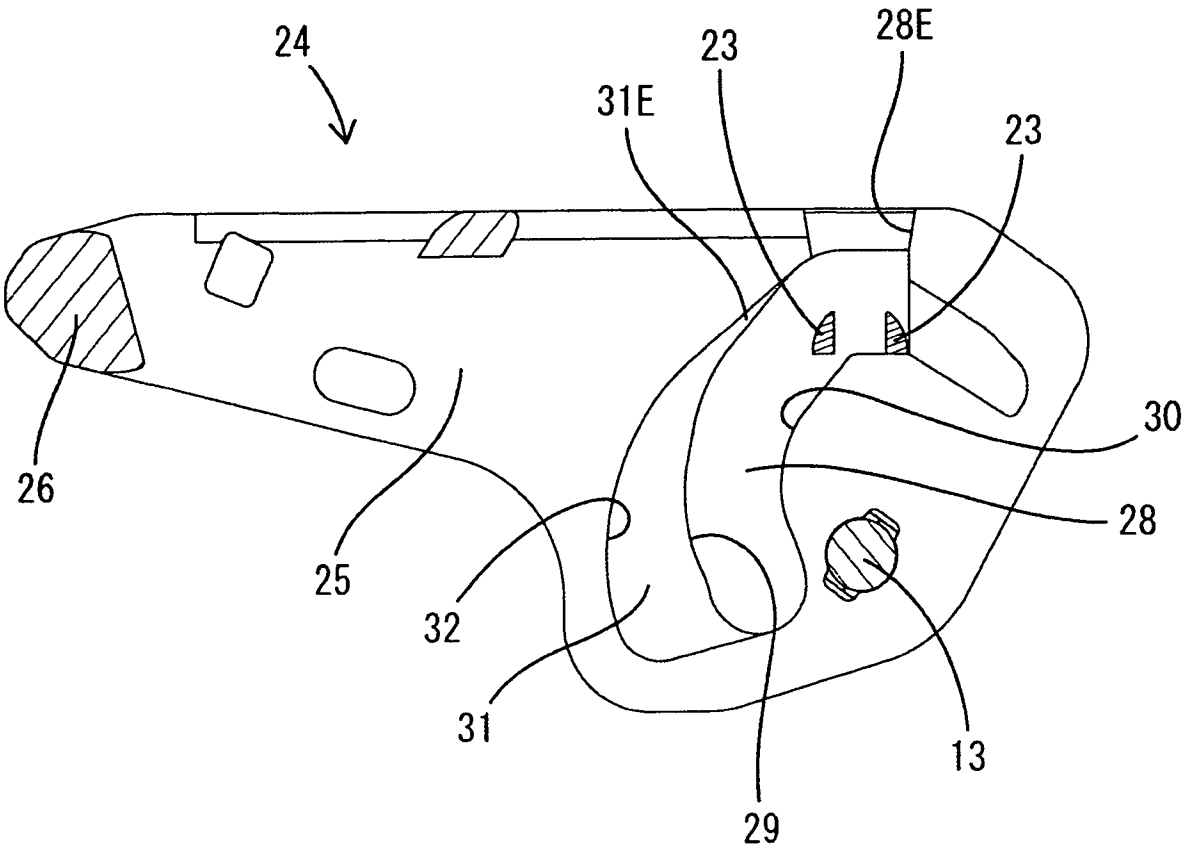
FIG. 4 is a side view in section showing a positional relationship of cam projections, a cam groove and an escaping space in a state where the male housing and the female housing are separated and the lever is at the initial position.
Figure 5:
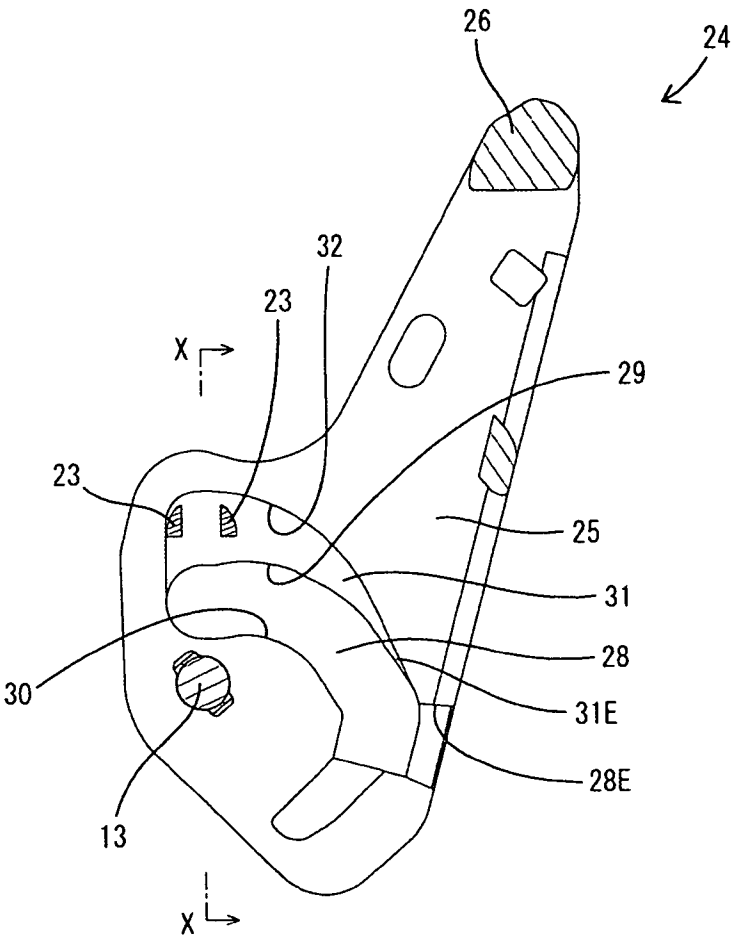
FIG. 5 is a side view in section showing a positional relationship of the cam projections, the cam groove and the escaping space in a state where the male housing and the female housing are separated and the lever is at the connection position.
Figure 6:
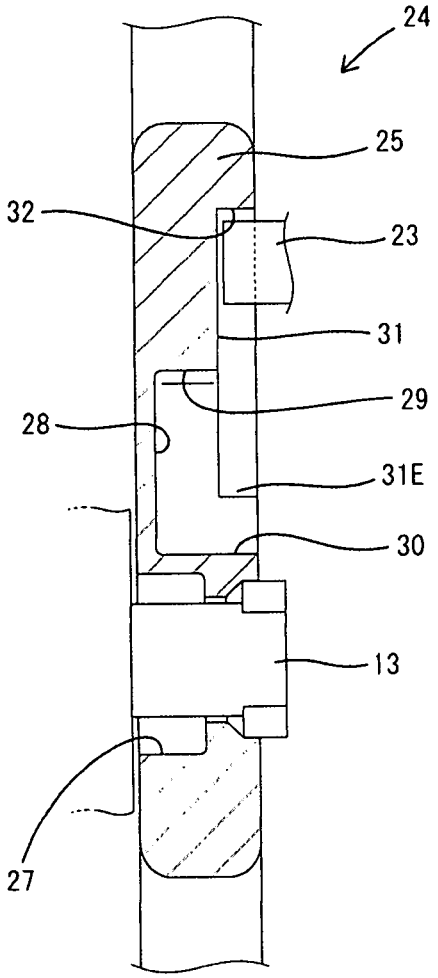
FIG. 6 is a section along X-X of FIG. 5.
Figure 7:
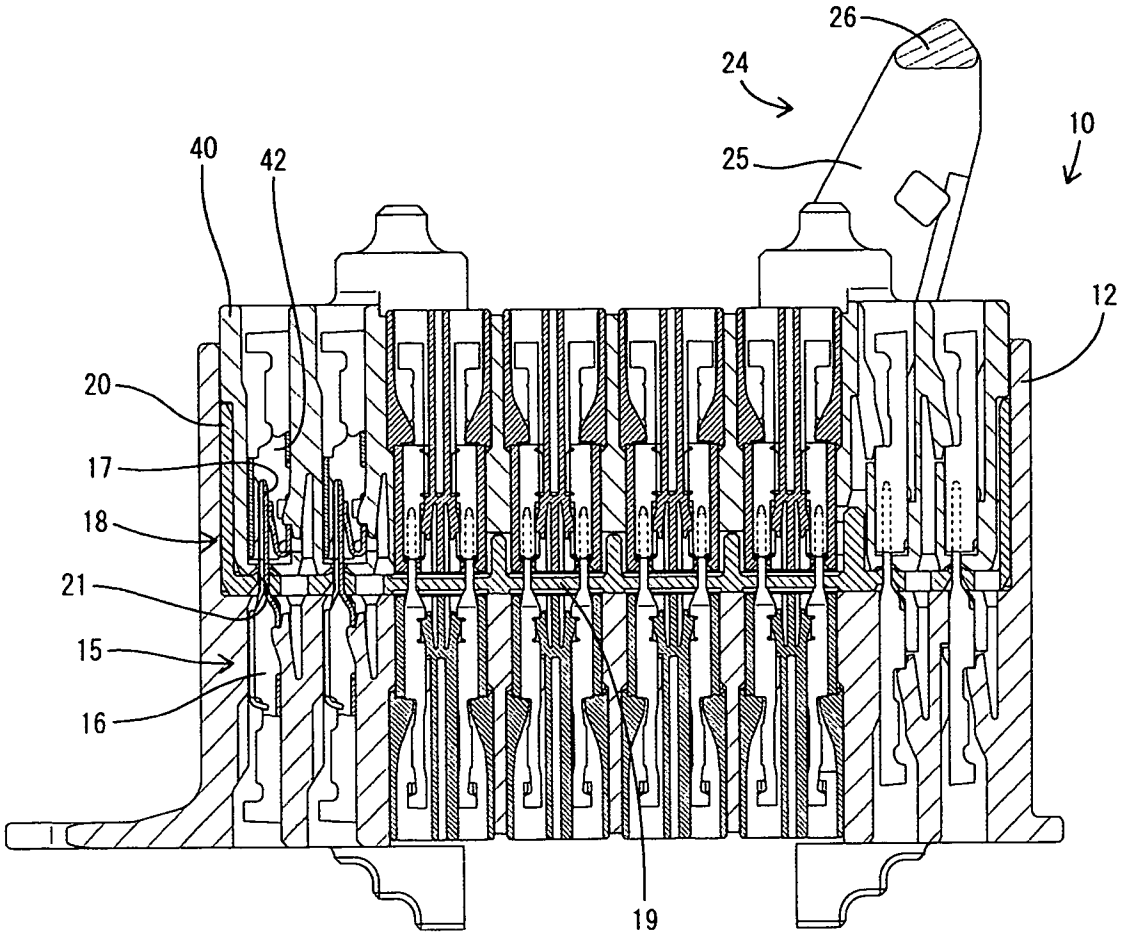
FIG. 7 is a side view in section showing a state where the male housing and the female housing are connected.
Figure 8:
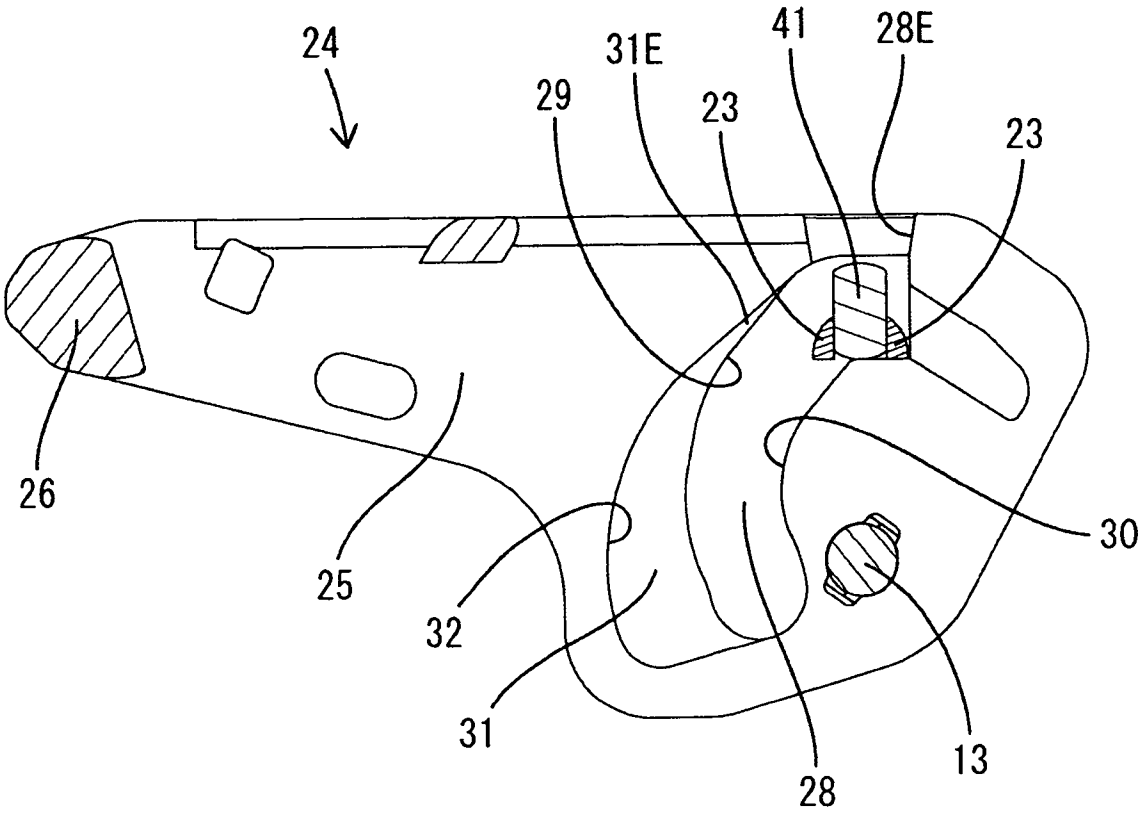
FIG. 8 is a side view in section showing a positional relationship of the cam projections, a cam pin, the cam groove and the escaping space in a state where the male housing and the female housing start being connected and the lever is at the initial position.
Figure 9:
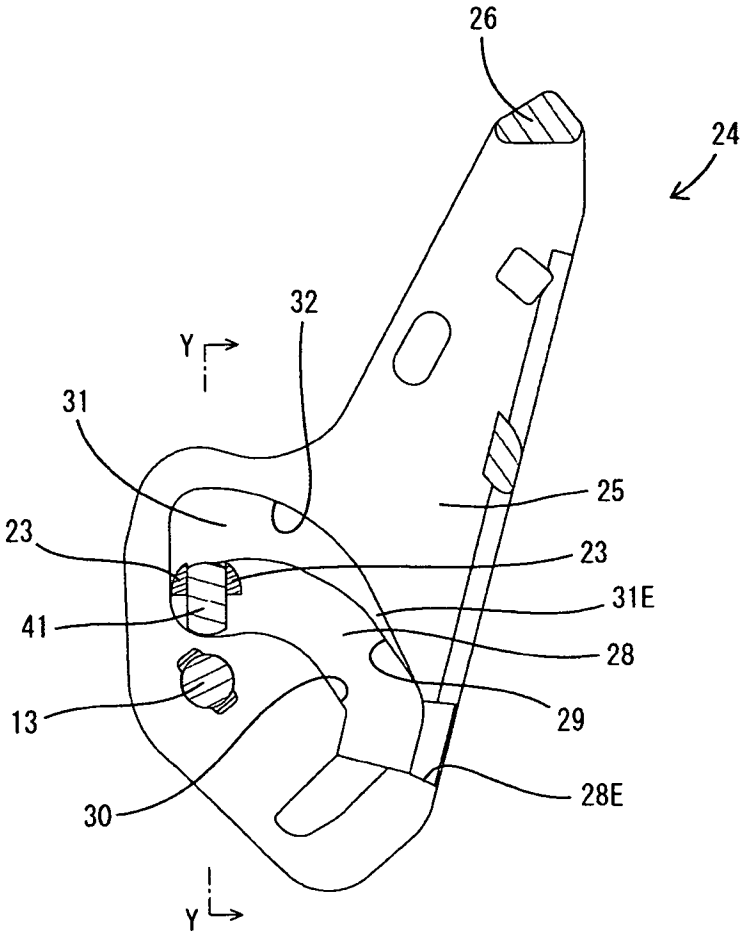
FIG. 9 is a side view in section showing a positional relationship of the cam projections, the cam pin, the cam groove and the escaping space in a state where the male housing and the female housing are connected and the lever is at the connection position.

In a state where the male housing 10 and the female housing 40 are separated and the lever 24 is at the initial position (see FIG. 2), the entrances 28E of the cam grooves 28 and the entrances 31E of the escaping spaces 31 are open up, and the cam projections 23 are in contact with or near the back ends of the entrances 28E of the cam grooves 28, as shown in FIG. 4. The moving plate 18 is at the protecting position when the cam projections 23 are at the entrances 28E of the cam grooves 28. Stoppers 33 on the receptacle 12 lock the moving plate 18 at the protecting position and restrict a movement to the retracted position.

If the female housing 40 is fit lightly into the receptacle 12 from this state, the female housing 40 is fit into the peripheral wall 20 of the moving plate 18 and approaches the upper surface of the plate body 19, i.e. faces the upper surface of the plate body 19 in a non-contact manner. At this time, the female housing 40 may contact the upper surface of the plate body 19. As the female housing 40 is fit lightly into the moving plate 18, the cam pins 41 enter the entrances 28E of the cam grooves 28 and move between the pairs of cam projections 23 to unite the cam pins 41 and the cam projections 23. At this time, the cam pins 41 contact the back surfaces of the entrances 28E and the upper ends (rear end parts in the connecting direction) of the cam pins 41 project up from the cam projections 23.

Further, the female housing 40 displaces the stoppers 33 so that the moving plate 18 can move to the retracted position. If the lever 24 at the initial position is rotated toward the connection position from this state, the cam pins 41 slide in contact with the connecting cam surfaces 29 of the cam grooves 28 to exhibit a boosting function so that the female housing 40 is pulled toward the male housing 10.

The connecting cam surfaces 29 press the upper ends of the cam pins 41 in an initial stage of the connecting process of the housings 10, 40. Thus, only the female housing 40 moves down (in the connecting direction). The connecting cam surfaces 29 are not in contact with the cam projections 23 during this time, and the moving plate 18 does not move from the protecting position. The female housing 40 comes into surface contact with the upper surface of the plate body 19 after slightly moving.

Thereafter, as the lever 24 is rotated, the the female housing 40 pushes the moving plate 18 back toward the lower end of the receptacle 12. The housings 10, 40 are connected properly when the lever 24 reaches the connection position, and the tabs 17 of the male terminal fittings 15 are inserted into the female housing 40 to be connected to the female terminal fittings 42.

The cam projections 23 and the connecting cam surfaces 29 do not contact each other until the lever 24 is rotated to the connection position after the female housing 40 comes into surface contact with the plate body 19. Thus, a positional relationship between the moving plate 18 and the female housing 40 in the vertical direction does not change. Accordingly, the female housing 40 and the plate body 19 are kept in surface contact with each other.

As just described, only the female housing 40 moves in the initial stage of rotating the lever 24 from the initial position to the connection position. The moving plate 18 and the female housing 40 then come into contact and unite. Thereafter, the female housing 40 is connected to the male housing 10 while being kept united with the moving plate 18 until the connection position is reached.

Upper ends of the cam projections 23 and upper ends of the cam pins 41 are at substantially the same position in the vertical direction. However, upper ends of the cam projections 23 may be upward of the connecting cam surfaces 29 while the lever 24 is being rotated to the connection position or in a state where the lever 24 has reached the connection position. Thus, the upper ends of the cam projections 23 may interfere with the lever 24. However, the escaping spaces 31 are above and adjacent to the connecting cam surfaces 29. Thus, upper parts of the cam projections 23 enter the escaping spaces 31 to avoid interference with the lever 24.

The lever 24 can be rotated from the connection position to the initial position with the housings 10, 40 connected. Thus, the separating cam surfaces 30 slide in contact with the cam projections 23 and the cam pins 41 so that the moving plate 18 is pushed up from the retracted position to the protecting position and the female housing 40 is pushed up to be separated from the male housing 10.

The cam projections 23 are separated a large distance from the separating cam surfaces 30 when the housings 10, 40 are connected. However, lower parts of the cam pins 41 project farther down than the lower ends of the cam projections 23 and contact or are near the separating cam surfaces 30. Thus, in the initial stage of rotation of the lever 24, the separating cam surfaces 30 slide in contact with only the lower end parts of the cam pins 41, and the female housing 40 is pushed up to separate from the plate body 19. During this time, the moving plate 18 does not move and the cam pins 41 move up with respect to the cam projections 23.

If the lever 24 is rotated more after the female housing 40 is separated from the plate body 19, the separating cam surfaces 30 start sliding in contact with the lower parts of the cam projections 23. Thereafter, the separating cam surfaces 30 slide in contact with both the cam projections 23 and the cam pins 41 and both the moving plate 18 and the female housing 40 move up until the lever 24 reaches the initial position. When the lever 24 returns to the initial position, the cam pins 41 and the cam projections 23 return to the entrances 28E of the cam grooves 28, and the housings 10, 40 can be separated by lifting the female housing 40.

An attempt may be made to cause the separating cam surfaces 30 to slide in contact with only the cam projections 23 in the process of rotating the lever 24 from the connection position to the initial position. However, the female housing 40 then is pushed in the separating direction by the plate body 19. In this case, a load equivalent to large separation resistance between the male housing 10 and the female housing 40 acts on the cam projections 23, and the cam projections 23 need to be enlarged to have high strength. If the cam projections 23 are enlarged, the escaping spaces 31 also need to be enlarged. Since the enlargement of the escaping spaces 31 leads to the expansion of thin areas in the lever 24, it is not preferable in terms of strength.

To avoid this, the female housing 40 disclosed herein is separated from the plate body 19 by causing the separating cam surfaces 30 to slide in contact with only the cam pins 41 in the initial stage of rotating the lever 24 from the connection position to the initial position. Thereafter, the female housing 40 and the plate body 19 are moved in the separating direction while being kept in the separated state by causing the separating cam surfaces 30 to slide in contact with both the cam projections 23 and the cam pins 41 until the lever 24 reaches the initial position after the separating cam surfaces 30 start sliding in contact with the cam projections 23. In this way, the miniaturization of the cam projections 23 can be miniaturized.

A contact area of the separating cam surface 30 with the cam projections 23 and the cam pin 41 is oblique to the connecting/separating direction, but an angle of inclination of the contact area of the separating cam surface 30 changes when rotating the lever 24. In addition, the cam projections 23 and the cam pin 41 are side by side in a direction intersecting the connecting/separating direction. Thus, a moving distance of the female housing 40 and a moving distance of the moving plate 18 when the lever 24 is rotated by a certain angle are subtly different. However, since the female housing 40 and the plate body portion 19 are spaced apart sufficiently, there is no possibility that the female housing 40 and the plate body 19 interfere with each other while rotating the lever 24.

Further, if the housings 10, 40 are separated and the lever 24 is returned to the initial position, the moving plate 18 returns to the protecting position. Since the operating portion 26 of the lever 24 is at a position deviated forward from an opening area of the receptacle 12 in this state, the entire area of the upper end of the receptacle 12 is open. However, the upward projecting dimension of the tabs 17 from the plate body 19 is small when the moving plate 18 is at the protecting position. Thus, there is no possibility that external matter interferes with the tabs 17.

In the lever-type connector of this embodiment, the lever 24 is rotated from the initial position to the connection position with the housings 10, 40 kept separated, such as when the male housing 10 is mounted on another member. If the connecting cam surfaces 29 of the lever 24 press the cam projections 23 when the lever 24 is rotated to the connection position, the moving plate 18 may drop to the retracted position, the projecting dimension of the tabs 17 from the plate body portion 19 may increase and the tabs 17 may be deformed due to interference of another member.

In contrast, the cam projections 23 do not interfere with the connecting cam surfaces 29 in the lever-type connector of this embodiment. Thus, the lever 24 does not exert pressing force on the cam projections 23 in the connecting direction. Further, the separating cam surfaces 30 become more distant from the cam projections 23 according to the rotation of the lever 24. Thus, the lever 24 does not exert pressing force on the cam projections 23 in the separating direction. As a result, the cam projections 23 enter the escaping spaces 31 and are displaced in a circumferential direction in the escaping spaces 31 according to the rotation of the lever 24. The cam projections 23 do not contact the lever 24 while being displaced in the escaping spaces 31, and the moving plate 18 is held at the protecting position.

Further, if the lever 24 is rotated to the initial position after being rotated to the connection position with the housings 10, 40 separated, the cam projections 23 are displaced in the escaping spaces 31 and return to the entrances 28E of the cam grooves 28. Since neither the separating cam surfaces 30 nor the connecting cam surfaces 29 contact the cam projections 23 during this time, the moving plate 18 is kept at the protecting position.

The lever 24 is formed with the connecting cam surfaces 29 and the escaping spaces 31. The connecting cam surfaces 29 press the cam pins 41 in the connecting direction while being kept out of contact with the cam projections 23 in the process of rotating the lever 24 from the initial position to the connection position. Further, the cam projections 23 are accommodated into the escaping spaces 31 while being kept out of contact with the connecting cam surfaces 29 in the process of rotating the lever 24 from the initial position to the connection position in a state where the housings 10, 40 are separated and the moving plate 18 is at the protecting position.

According to this configuration, the connecting cam surfaces 29 do not contact the cam projections 23 in the escaping spaces 31. Thus, no pressing force in the connecting direction acts on the moving plate 18, and the moving plate 18 can be held at the protecting position. Further, the cam grooves 28 function as spaces for displacing the cam projections 23 and also as spaces for displacing the cam pins 41. Thus, the shape of the lever 24 is simplified as compared to a case where dedicated passages for displacing the cam pins 41 in the connecting process are formed separately from the cam grooves 28.

The lever 24 is formed with the cam grooves 28. Each cam groove 28 is curved to approach the rotary shaft 13 (center of rotation of the lever 24) from the entrance 28E toward the back. In the process of rotating the lever 24 from the initial position to the connection position while sliding in contact with the cam pins 41, the cam grooves 28 function as first passages enabling the cam projections 23 to be displaced toward the rotary shafts 13.

Similarly, the escaping spaces 31 of the lever 24 function as second passages for allowing the cam projections 23 to be displaced without changing a positional relationship with the rotary shafts 13 in the process of rotating the lever 24 from the initial position to the connection position in a state out of contact with the cam pins 41. Thus, if the lever 24 is rotated from the initial position to the connection position in a state where the housings 10, 40 are separated and the lever 24 is out of contact with the cam pins 41, the cam projections 23 are displaced in the escaping spaces 31 while being kept in such a state as not to approach the center of rotation of the lever 24. Thus, the moving plate 18 also does not move from the protecting position.

The lever 24 is formed with the separating cam surfaces 30 and the escaping spaces 31 disposed in the areas more distant from the rotary shafts 13 than the separating cam surfaces 30. In the process of rotating the lever 24 at the connection position to the initial position with the housings 10, 40 connected, the separating cam surfaces 30 press the cam projections 23 in a direction away from the rotary shafts 13 to separate the housings 10, 40. Further, in the process of rotating the lever 24 from the initial position to the connection position in the state where the housings 10, 40 are separated and the moving plate 18 is at the protecting position, the cam projections 23 are accommodated into the escaping spaces 31 while being separated from the separating cam surfaces 30.

According to this configuration, with the housings 10, 40 separated, the cam projections 23 are pushed by the separating cam surfaces 30 to be disposed at positions most distant from the rotary shafts 13 of the lever 24. The escaping spaces 31 are in the areas more distant from the rotary shafts 13 than the separating cam surfaces 30. Thus, in the process of rotating the lever 24 toward the connection position with the housings 10, 40 separated, the cam projections 23 accommodated in the escaping spaces 31 do not approach the rotary shafts 13. In this way, the moving plate 18 is held at the protecting position.

The female housing 40 is formed with the cam pins 41. In a state where the female housing 40 is fit in the receptacle 12 and the cam pins 41 and the cam projections 23 are united, a projecting dimension of the cam pins 41 from the outer side surfaces of the male housing 10 is larger than that of the cam projections 23 from the outer side surfaces of the male housing 10. On the other hand, the lever 24 is formed with the cam grooves 28 for accommodating the cam projections 23 and the cam pins 41 in the process of connecting/separating the housings 10, 40. Similarly, the lever 24 has the escaping spaces 31 for restricting entrance of the cam pins 41 by being recessed more shallowly than the cam grooves 28. The escaping spaces 31 are shallower than the cam grooves 28.

In the process of rotating the lever 24 from the initial position to the connection position in the state where the both housings 10, 40 are separated and the moving plate 18 is at the protecting position, the cam projections 23 are accommodated into the escaping spaces 31 while being kept out of contact with the lever 24. Thus, no pressing force in the connecting direction acts on the moving plate 18, wherefore the moving plate 18 can be held at the protecting position. Further, in the connecting process of the both housings 10, 40, the cam pins 41 are prevented from erroneously entering the escaping spaces 31.

The lever 24 is formed with the cam grooves 28 capable of accommodating the cam projections 23 and the cam pins 41 in the connecting process of the housings 10, 40, and the cam grooves 28 are formed with the connecting cam surfaces 29. The escaping spaces 31 are adjacent to the connecting cam surfaces 29 and communicate with the cam grooves 28. Since the escaping spaces 31 communicate with the cam grooves 28, the cam projections 23 and the cam pins 41 can be moved in the cam grooves 28 while being united in a step of connecting the housings 10, 40. Further, since the cam grooves 28 double as movement paths for the cam projections 23 in the connecting process of the housings 10, 40, the shape of the lever 24 can be simplified as compared to the case where the lever 24 is formed with movement paths dedicated for the cam projections 23 separately from the cam grooves 28.

The escaping spaces 31 may be in the areas more distant from the rotary shafts 13 than the connecting cam surfaces 29. According to this configuration, the cam projections 23 do not approach the center of rotation of the lever 24 when rotating the lever 24 from the initial position to the connection position with the housings 10, 40 separated. Thus, the moving plate 18 can be held at the protecting position.

Further, the lever 24 is formed with the separating cam surfaces 30. The separating cam surfaces 30 press the cam projections 23 in the process of separating the housings 10, 40 by rotating the lever 24 toward the initial position from the state where the housings 10, 40 are connected. Thus, the moving plate 18 is moved toward the protecting position. According to this configuration, if the lever 24 is rotated from the connection position to the initial position with the housings 10, 40 connected, the separating cam surfaces 30 press the cam projections 23 to move the moving plate 18 to the protecting position. The housings 10, 40 are separated in the process of moving the moving plate 18 to the protecting position.

The cam grooves 28 press the cam pins 41 of the female housing 40 in the connecting direction as the lever 24 is rotated from the initial position to the connection position when connecting the housings 10, 40. The escaping spaces 31 communicate with the cam grooves 28, and the cam grooves 28 are formed with the separating cam surfaces 30. According to this configuration, the cam grooves 28 function both as the movement paths for the cam pins 41 in the connecting process and as the movement paths for the cam projections 23 in the separating process. Thus, the shape of the lever 24 is simplified as compared to the case where the lever 24 is formed with separating movement spaces dedicated for the cam projections 23 separately from the cam grooves 28.

The entrance 31E of the escaping space 31 is adjacent to and communicates with the entrance 28E of the cam groove 28, and the escaping space 31 is in the area more distant from the rotary shaft 13 than the cam groove 28 in the area backward of the entrances 28E, 31E in the cam groove 28 and the escaping space 31. According to this configuration, the entrance 28E of the cam groove 28 and the entrance 31E of the escaping space 31 are adjacent to and communicate with each other. Thus, the shape of the lever 24 is simplified as compared to the case where the entrance 28E of the cam groove 28 and the entrance 31E of the escaping space 31 are separate and do not communicating with each other.

The lever 24 has the restricting surfaces 32 that face the rotary shafts 13 and extend along the outer periphery of the escaping spaces 31. According to this configuration, the cam projections 23 contact the restricting surfaces 32. Thus, the moving plate 18 at the protecting position cannot move toward a side opposite to the retracted position and is separated through the opening in the front surface of the receptacle 12. Note that the cam projections 23 displaced in the escaping spaces 31 are kept out of contact with the restricting surfaces 32 in the process of rotating the lever 24 between the initial position and the connection position with the housings 10, 40 separated. Thus, there is no possibility that the moving plate 18 will drop from the protecting position toward the retracted position.

The invention is not limited to the above described embodiment. For example, the following embodiments also are included in the scope of the invention.

Although the escaping space is adjacent to the connecting cam surface in the above embodiment, the escaping space may be separated from the connecting cam surface. In this case, a separation wall may exist between the escaping space and the connecting cam surface.

Although the moving plate is held at the protecting position when rotating the lever from the initial position to the connection position with the housings separated, the moving plate may move slightly toward the retracted position when rotating the lever.

The cam groove is on the inner peripheral side closer to the rotary shaft than the escaping space. However, the escaping space may be on the inner peripheral side closer to the rotary shaft than the cam groove. In this case, the cam pin and the cam projections may be prevented from being united in the connecting process of the housings.

Although the restricting surface is formed along the outer peripheral edge of the escaping space in the above embodiment, the escaping space may not be formed with the restricting surface and may be open in the outer periphery of the lever.

Although the entrances of the cam groove and the escaping space are adjacent and communicate with each other in the above embodiment, the entrance of the cam groove and that of the escaping space may be separate spaces.

LIST OF REFERENCE SIGNS

10 . . . male housing
12 . . . receptacle
13 . . . rotary shaft (center of rotation of lever)
15 . . . male terminal fitting
17 . . . tab
18 . . . moving plate
23 . . . cam projection
24 . . . lever
28 . . . cam groove
29 . . . connecting cam surface
30 . . . separating cam surface
31 . . . escaping space
32 . . . restricting surface
40 . . . female housing
41 . . . cam pin

What is claimed is:

1. A lever-type connector, comprising:

a male housing including a tubular receptacle projecting toward a front surface;

male terminal fittings mounted in the male housing and including tabs surrounded by the receptacle;

a moving plate accommodated in the receptacle and movable between a protecting position where tips of the tabs are positioned through the moving plate and a retracted position backward of the protecting position;

a cam projection formed on the moving plate;

a lever mounted on the male housing and rotatable between an initial position and a connection position;

a female housing that is fittable into the receptacle and that includes a cam pin;

a connecting cam surface formed in the lever and capable of pressing the cam pin in a connecting direction while being kept out of contact with the cam projection in the process of rotating the lever from the initial position to the connection position; and an escaping space formed in the lever;

the cam projection being accommodated into the escaping space while being kept out of contact with the connecting cam surface when rotating the lever from the initial position to the connection position in a state where the male housing and the female housing are separated and the moving plate is at the protecting position.

2. The lever-type connector of claim 1, wherein:

the lever is formed with a cam groove capable of accommodating the cam projection and the cam pin in a connecting process of the male housing and the female housing;

the connecting cam surface is formed in the cam groove; and the escaping space is adjacent to the connecting cam surface and communicates with the cam groove.

3. The lever-type connector of claim 2, wherein:

the escaping space is shallower than the cam groove; and a projecting dimension of the cam pin is larger than a projecting dimension of the cam projection.

4. The lever-type connector of claim 3, wherein the escaping space is in an area more distant from a center of rotation of the lever than the connecting cam surface.

5. The lever-type connector of claim 4, wherein the lever is formed with a separating cam surface for moving the moving plate toward the protecting position by pressing the cam projection in the process of separating the male and female housings.

6. The lever-type connector of claim 5, wherein the lever is formed with a restricting surface disposed to face a center of rotation of the lever and extend along an outer peripheral edge of the escaping space.

7. The lever-type connector of claim 1, wherein:

the escaping space is shallower than the cam groove; and a projecting dimension of the cam pin is larger than a projecting dimension of the cam projection.

8. The lever-type connector of claim 1, wherein the escaping space is in an area more distant from a center of rotation of the lever than the connecting cam surface.

9. The lever-type connector of claim 1, wherein the lever is formed with a separating cam surface for moving the moving plate toward the protecting position by pressing the cam projection in the process of separating the male and female housings.

10. The lever-type connector of claim 1, wherein the lever is formed with a restricting surface disposed to face a center of rotation of the lever and extend along an outer peripheral edge of the escaping space.

* * * * *